US006172286B1

(12) United States Patent
Liu

(10) Patent No.: US 6,172,286 B1
(45) Date of Patent: Jan. 9, 2001

(54) TRANSMISSION STRUCTURE FOR STIMULATING THE ACTIONS OF A CRADLE

(76) Inventor: Jack Liu, No. 3, Alley 202, Kao-Fon Road, Hsin-Chu City (TW)

( * ) Notice: Under 35 U.S.C. 154(b), the term of this patent shall be extended for 0 days.

(21) Appl. No.: 09/425,028

(22) Filed: Oct. 25, 1999

(30) Foreign Application Priority Data

Oct. 31, 1998 (TW) ..... 97218040

(51) Int. Cl.[7] ..... G10F 1/06
(52) U.S. Cl. ..... 84/95.1; 84/95.2
(58) Field of Search ..... 84/94.1, 95.2, 84/95.1, 97, 98, 99, 106, 107

(56) References Cited

U.S. PATENT DOCUMENTS 3,149,525 * 9/1964 Marder ..... 84/95
4,341,142 * 7/1982 Komatsu et al. ..... 84/95 R
4,557,173 * 12/1985 Isaka ..... 84/95 R
5,438,153 * 8/1995 Chen ..... 84/95.1
5,449,856 * 9/1995 Nakamori ..... 84/95.1
5,459,278 * 10/1995 Hsu ..... 84/95.1
5,510,570 4/1996 Liu .
5,532,423 7/1996 Liu .

* cited by examiner

*Primary Examiner*—Robert E. Nappi
*Assistant Examiner*—Kim Lockett
(74) *Attorney, Agent, or Firm*—Rabin & Champagne, P.C.

(57) ABSTRACT

A transmission structure for simulating actions of a cradle is disclosed. The transmission structure comprises a frame, gears, a slidable seat, and other components. The frame is fixed above a music bell. A driving gear is installed at the groove of the frame; and a transmission gear is installed between the lower portion of the frame and the teeth of the roller. The driving gear is engaged with the transmission gear. A slidable seat is installed at the upper surface of the frame. The notch of the slidable seat is at the pin position of the driving gear. By the aforesaid structure, as the transmission gear is driven by a music bell, the slidable seat is pushed by the pin of the driving gear so as to move straightly and repeatedly.

6 Claims, 3 Drawing Sheets

TRANSMISSION STRUCTURE FOR STIMULATING THE ACTIONS OF A CRADLE

FIELD OF THE INVENTION

The present invention relates to a transmission structure for simulating the actions of a cradle, and especially to a structure, wherein the power of a music bell serves to drive a cradle decoration to swing.

BACKGROUND OF THE INVENTION

U.S. Pat. Nos. 5,510,570 and 5,532,423 disclose a structure, wherein the power of a music bell serves to drive a cradle decoration to swing.

In the U.S. Pat. No. 5,510,570, a decoration includes an object, which may rotate and/or swing upwards and downwards repeatedly. The form of the actions of the decoration is different from the present invention. Thus, the transmission structures are also different.

Moreover, in U.S. Pat. No. 5,532,423, a music bell serves to drive a linkage to swing. By the swinging of the linkage, the decoration may move repeatedly. However, in the process of driving the linkage to swing, the horizontal position of the linkage is also changed. Thus, the moving mode is not suitable in some situations.

SUMMARY OF THE INVENTION

Accordingly, the primary object of the present invention is to provide a transmission structure for simulating actions of a cradle. A transmission structure includes a frame, gears, a slidable seat. The frame is fixed above a musical bell. A driving gear is installed at the groove of the frame; and a transmission gear is installed between a lower portion of the frame and the teeth of the roller. The driving gear is engaged with the transmission gear. A slidable seat is installed at the upper surface of the frame. The notch of the slidable seat is at the pin position of the driving gear.

According to the structure, as the transmission gear is driven by the bell, the slidable seat is pushed by the pin of the driving gear so as to move straightly and repeatedly. Since the slidable seat slides horizontally along the tracks. Therefore, as the decoration moves linearly, it will retain in the same horizontal level.

The various objects and advantages of the present invention will be more readily understood from the following detailed description when read in conjunction with the appended drawing.

DETAILED DESCRIPTION OF THE PREFERRED EMBODIMENTS

The present invention will be described in more detail in the following with reference to the appended figures.

Figure 1:
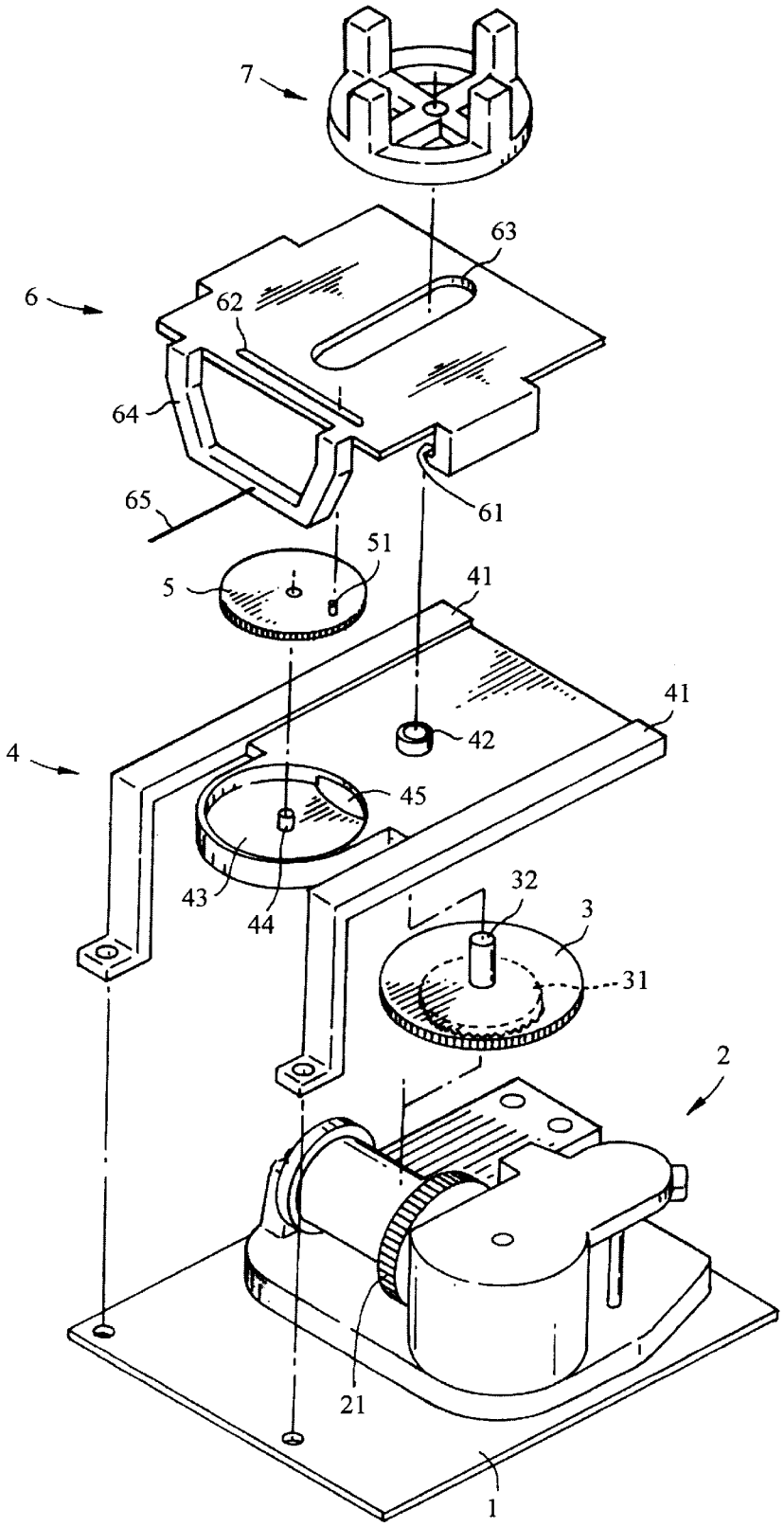
FIG. 1 is an assembled schematic view of the present invention.
Figure 2:
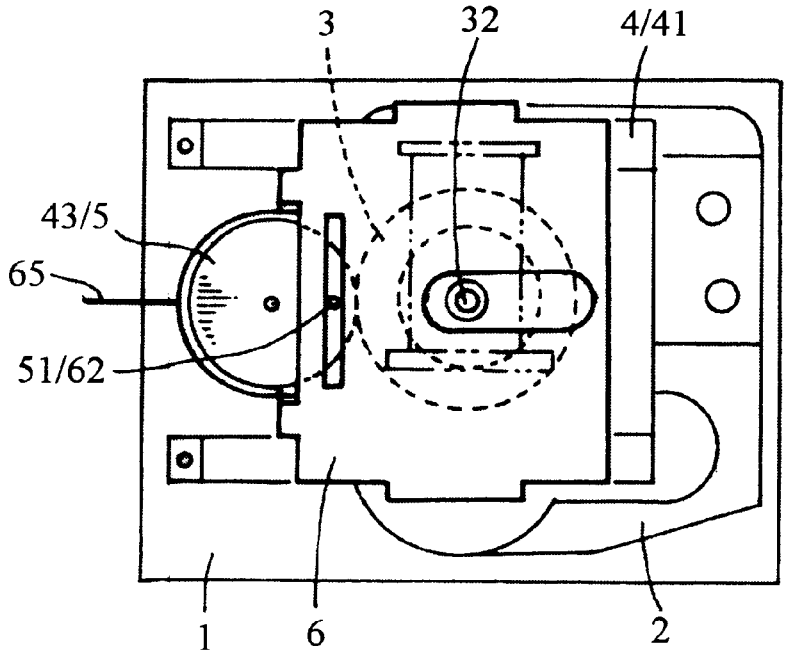
FIG. 2 is an upper view of the present invention showing the slidable seat in an inserting position.
Figure 3:
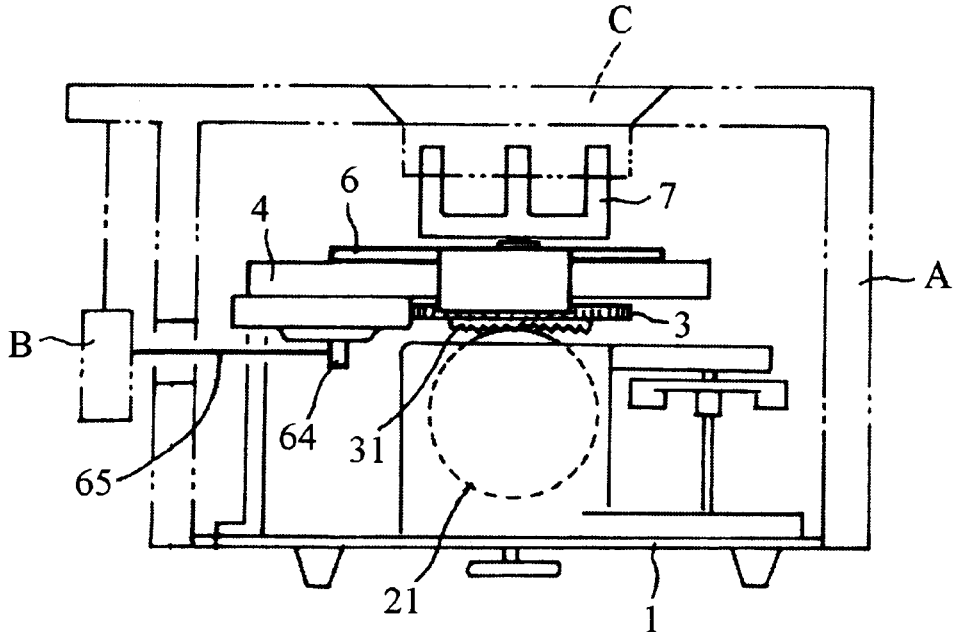
FIG. 3 is a lateral view of FIG. 2.

With reference to FIGS. 1–3, the transmission structure of the present invention is illustrated. The transmission structure of the present invention includes a frame, gears, a slidable seat, etc. A bell 2 is fixed to the base 1. The frame 4 is fixed above the bell 2 along the seat 1. Two sides of the frame 4 are installed with parallel slidable tracks 41. One end of the frame 4 is installed with a groove 43. An opening 45 is installed at the rim of the groove 43, and an axial hole 42 is installed approximately at the center of the frame 4.

Moreover, since a driving gear 5 is installed at the groove 43 of the frame, the axial center 44 of the groove is the rotation center of the driving gear 5, and a longitudinal pin 51 is installed at the peripheral edge of the upper surface of the driving gear 5.

Furthermore, a transmission gear 3 is installed between the lower portion of the frame 4 and the teeth 21 of the roller. The rotary shaft 32 of transmission gear 3 is inserted into the axial hole 42 of the frame. A driving palm 7 is installed at the upper end of the rotary shaft 32. The transmission gear 3 passes through the opening 45 of the groove 43 so as to engage with the driving gear 5.

The lower surface of the transmission gear 3 is integrally formed with a crown gear 31. The crown gear 31 is engaged with the teeth 21 of the roller on the bell 2. As the roller of the bell 2 rotates, the teeth 21 of the roller drive the driving gear 5 to rotate through crown gear 31 of the driving gear 3.

Moreover, the upper surface of the frame 4 is installed with a slidable seat 6. Two sides of the slidable seat 6 are installed with slidable grooves 61 with respect to the slidable tracks 41. Therefore, the slidable seat 6 slides along the slidable tracks 41. A notch 62 is installed relative to the pin 51 of the driving gear 5, so that the pin 51 may extend to the coverage of the notch 62. A hole 63 is installed on the slidable seat 6 at the position with respect to the axial hole 42 of the frame. The front end of the slidable seat 6 is installed with a support 64. A steel wire extending out of the support 64 further extends out of the box A and then is connected to a decoration B, such as a swing basket.

Figure 4:
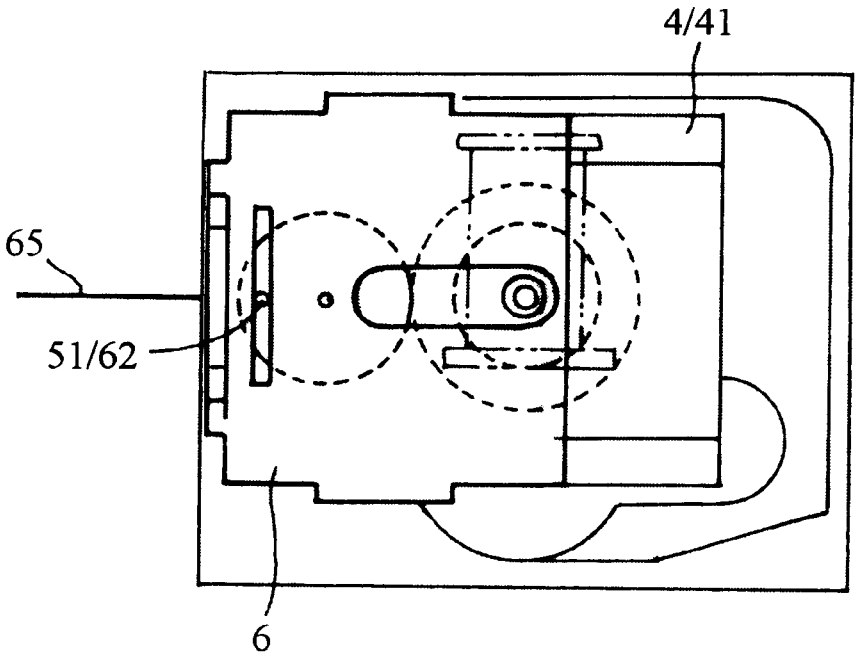
FIG. 4 is an upper view showing the slidable seat moving to an extended position.
Figure 5:
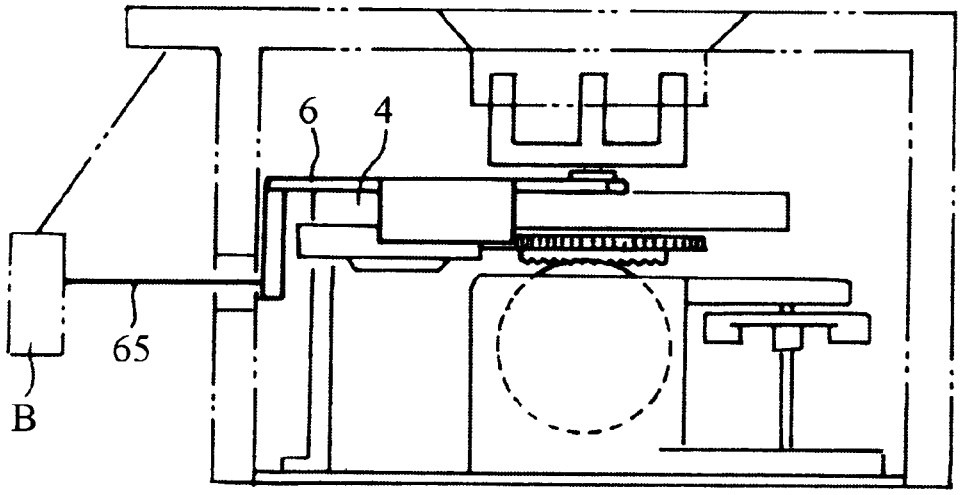
FIG. 5 is a lateral view of FIG. 4.

By the aforesaid structure, when the roller of the bell 2 rotates to drive the driving gear 5 to rotate, the pin 51 of the driving gear 5 extends to the coverage of the notch 62 of the slidable seat. Therefore, the pin 51 moving circularly may push the slidable seat 6 along the notch 62 to move in the slidable track 41 repeatedly, as shown in FIGS. 4 and 5. That is, the decoration B may be pushed by the steel wire 65 so to swing as a cradle.

Furthermore, a driving palm 7 is installed at the upper end of the driving shaft 32 of the driving gear above the slidable seat 6. The driving palm 7 moves synchronously with the transmission gear 3. Therefore, in the application of this embodiment, the dynamic force of rotation of the driving palm 7 can be used to drive a rotary disk C, so that other decorations installed on the rotary disk can present various dynamic phenomenon.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A transmission structure for a cradle, comprising:

a frame;

gears; and a slidable seat, wherein:

said frame is disposed above a bell, two sides of the frame are installed using tracks, one end of said frame includes a groove, and an opening is installed at a rim of said groove;

and wherein further said gears include:

a driving gear installed at said groove, wherein a longitudinal pin is installed at a peripheral edge of an upper surface of said driving gear, a transmission gear installed between a lower portion of said frame and teeth of a roller of said bell, wherein said transmission gear passes through an opening of said groove so as to engage with said driving gear, and the lower surface of said transmission gear is formed integrally with a crown gear, and said crown gear is engaged with the teeth of said roller on said bell; and wherein further said slidable seat is installed at an upper surface of said frame, wherein sliding grooves are installed at two sides of said slidable seat with respect to the sliding tracks of said frame, and a notch is installed said slidable seat with respect to the pin of said driving gear.

2. The transmission structure as claimed in claim 1, wherein a support is installed in front of said slidable seat.

3. The transmission structure as claimed in claim 2, wherein in said support, a steel wire extends out of a box and is connected to a decoration.

4. The transmission structure as claimed in claim 1, wherein a hole is installed at said slidable seat with respect to the axial hole.

5. The transmission structure as claimed in claim 1, wherein a driving palm is installed at the upper end of said driving shaft of said driving gear above said slidable seat.

6. The transmission structure as claimed in claim 5, wherein said driving palm drives a rotary disk.

* * * * *